US006574835B2

(12) United States Patent
Melhuish

(10) Patent No.: US 6,574,835 B2
(45) Date of Patent: Jun. 10, 2003

(54) HINGE FOR AN OVER-HEAD STORAGE COMPARTMENT HAVING NON-CENTERED PIVOTING MOTION

(75) Inventor: Robert A. Melhuish, East Greenville, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 09/881,851

(22) Filed: Jun. 15, 2001

(65) Prior Publication Data

US 2002/0189052 A1 Dec. 19, 2002

(51) Int. Cl.[7] ..... E05F 1/14

(52) U.S. Cl. ..... 16/282; 16/281; 16/286; 16/289; 16/292; 16/294; 16/370

(58) Field of Search ..... 16/280–283, 286–292, 16/306, 370, 294; 49/206, 386; 312/319.1, 319.2, 325, 323

(56) References Cited

U.S. PATENT DOCUMENTS

| | | | | | |
|---|---|---|---|---|---|
| 2,956,303 | A | * | 10/1960 | Fiedler | 16/288 |
| 3,054,137 | A | * | 9/1962 | Pulleyblank | 16/288 |
| 3,802,125 | A | | 4/1974 | Baker | |
| 3,857,623 | A | | 12/1974 | Schneller | |
| 4,223,420 | A | * | 9/1980 | Yukimoto et al. | 16/288 |
| 4,429,494 | A | * | 2/1984 | Kornerup et al. | 49/346 |
| 4,756,054 | A | * | 7/1988 | Mitts et al. | 16/237 |
| 4,817,240 | A | * | 4/1989 | Sovis et al. | 126/194 |
| 4,843,680 | A | * | 7/1989 | Cress et al. | 16/237 |
| 4,915,461 | A | | 4/1990 | Kingsborough et al. | |
| 5,172,969 | A | | 12/1992 | Reuter et al. | |
| D339,934 | S | | 10/1993 | Reuter | |
| 5,409,308 | A | | 4/1995 | Reuter et al. | |
| 5,488,757 | A | * | 2/1996 | Cohen et al. | 16/280 |
| 5,664,290 | A | * | 9/1997 | Scherrer | 16/287 |
| 5,971,514 | A | * | 10/1999 | Hayakawa | 16/291 |
| 6,073,624 | A | | 6/2000 | Laurent | |

* cited by examiner

*Primary Examiner*—Chuck Y. Mah
(74) *Attorney, Agent, or Firm*—Buchanan Ingersoll, P.C.

(57) ABSTRACT

A hinge used to mount a door to an overhead storage cabinet is disclosed. The hinge provides a combination linear and articulated motion to provide the clearance between the door of the cabinet and the upper, outer corner of the cabinet. Further, the hinge provides a user assist on the opening of the cabinet door and a self-dampening motion on the closing of the cabinet door without the use of pneumatic cylinders.

15 Claims, 8 Drawing Sheets

HINGE FOR AN OVER-HEAD STORAGE COMPARTMENT HAVING NON-CENTERED PIVOTING MOTION

FIELD OF THE INVENTION

Figure 1:
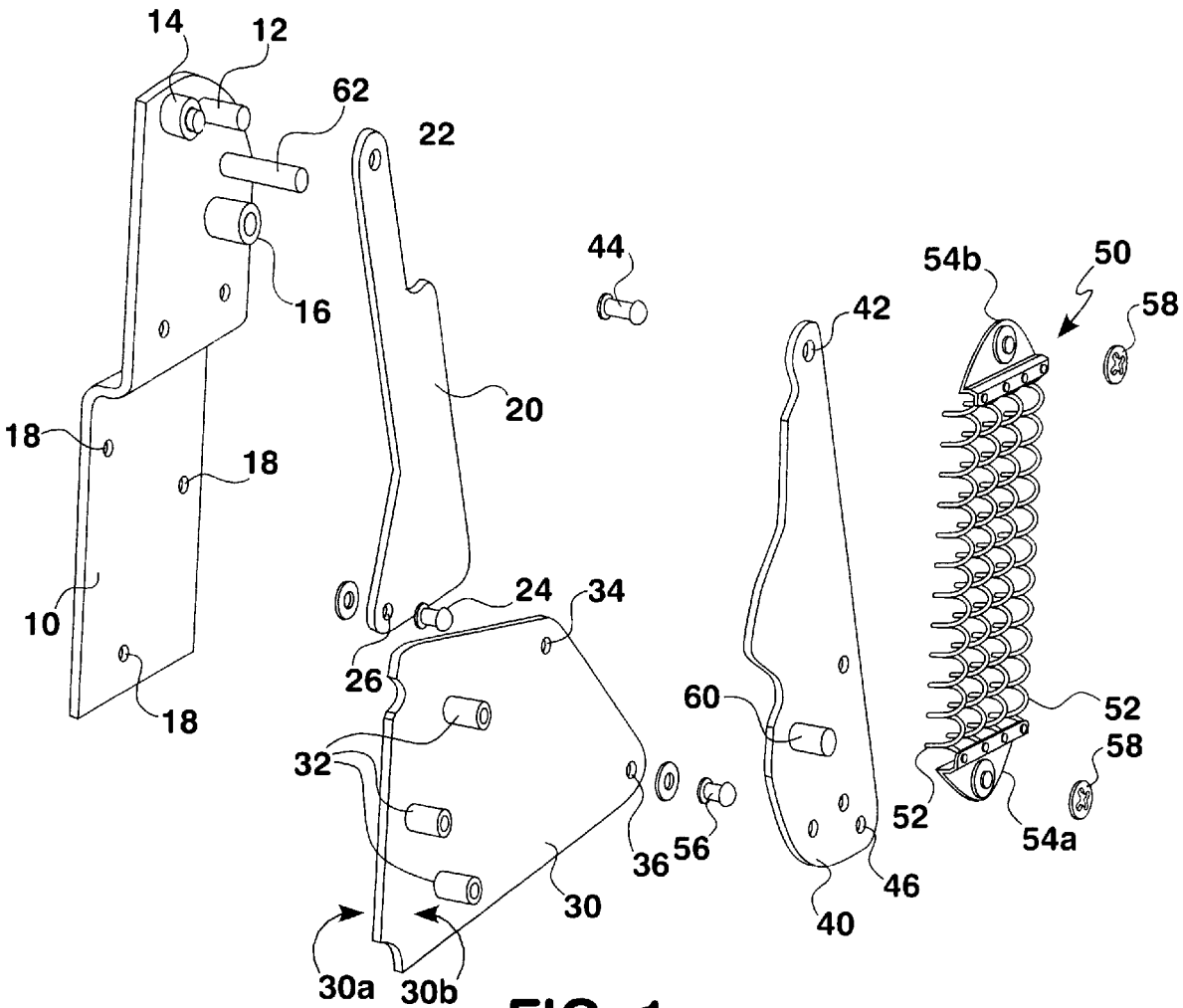

This invention relates to a hinge for mounting a door to the frame of a cabinet of the type used as an over-head storage container. In particular, this is a concealed hinge of the type that provides an articulated motion and has self-dampening characteristics during the opening and closing of the cabinet doors.

BACKGROUND OF THE INVENTION

This invention relates to a hinge of the type that would commonly be found in an overhead storage cabinet for a modular office system or cubicle. These types of storage cabinets hang on the wall panel at approximately eye height and are normally opened by swinging the door upward and backward, such that the door is supported on top of the unit. Typically, the doors on these types of cabinets are attached to the frame of the cabinet via a special kind of hinge using a pneumatic cylinder or a rack and pinion type mechanism.

With respect to this invention, the type of cabinet being referred to would be an overhead storage bin having door which is vertical when in the closed position. To open the door the user pulls the door horizontally away from the frame of the cabinet and upwardly. The desired effect is to have the door suspended at an angle between horizontal and vertical above the cabinet when in the open position. It is therefore an objective of this invention to provide a hinge that allows a combination linear/articulated motion as the door is being opened to allow clearance for the door around the upper, outer corner of the cabinet frame.

It is also desirable that the hinge be self-dampening to provide a quality feedback to the user when the door is opened or closed and to hold the door in an extended upright position when opened. Many prior art hinges provide a dampened type of motion during opening and closing using a pneumatic cylinder. In these cases the pneumatic cylinder also serves to hold the door in the upright position when opened. However, one drawback with pneumatic cylinders is that they are bulky and expensive. It is therefore on objective of this invention to provide a hinge which first, provides the user with a mechanical assist in the opening of the door, second, is able to hold the door in the upright, opened position, and third, provides a dampened closing motion to prevent slamming of the door as the door is closed. Preferably, these objectives should be met without the use of a pneumatic cylinder.

SUMMARY OF THE INVENTION

The hinge disclosed herein meets all of the objectives noted above and addresses the deficiencies in the prior art. First, the hinge provides a non-centered pivoting motion. That is, the door of the cabinet does not rotate about a single axis throughout the entire range of travel from the closed to open positions or from the open to closed positions. Instead, the door first moves radially outward from the cabinet frame, then articulates in an upward arc around the upper, outer corner of the cabinet frame, coming to rest in the opened position above the cabinet frame and at an angle between horizontal and vertical, thus providing clearance for the door around the upper, outer corner. Additionally, the hinge provides the required dampened motion without the use of pneumatic cylinders. As the user pulls the door outwardly and upwardly away from the cabinet frame, a certain point is reached after which the hinge will assist the user and pull the door the remaining distance to a full upright and opened position. The dampening force is provided by one or more springs connected to several structural members of the hinge. The springs also serve to hold the door in the upright position while opened. Lastly, the motion of the hinge is dampened, using the same springs, upon closing, to prevent slamming of the door. Thus, the desirable qualities of a hinge using a pneumatic cylinder are realized through the use of less expensive, more space-efficient springs.

DETAILED DESCRIPTION OF THE DRAWINGS

FIG. 1 is an exploded view of the hinge showing all the parts thereof.

Figure 2A:
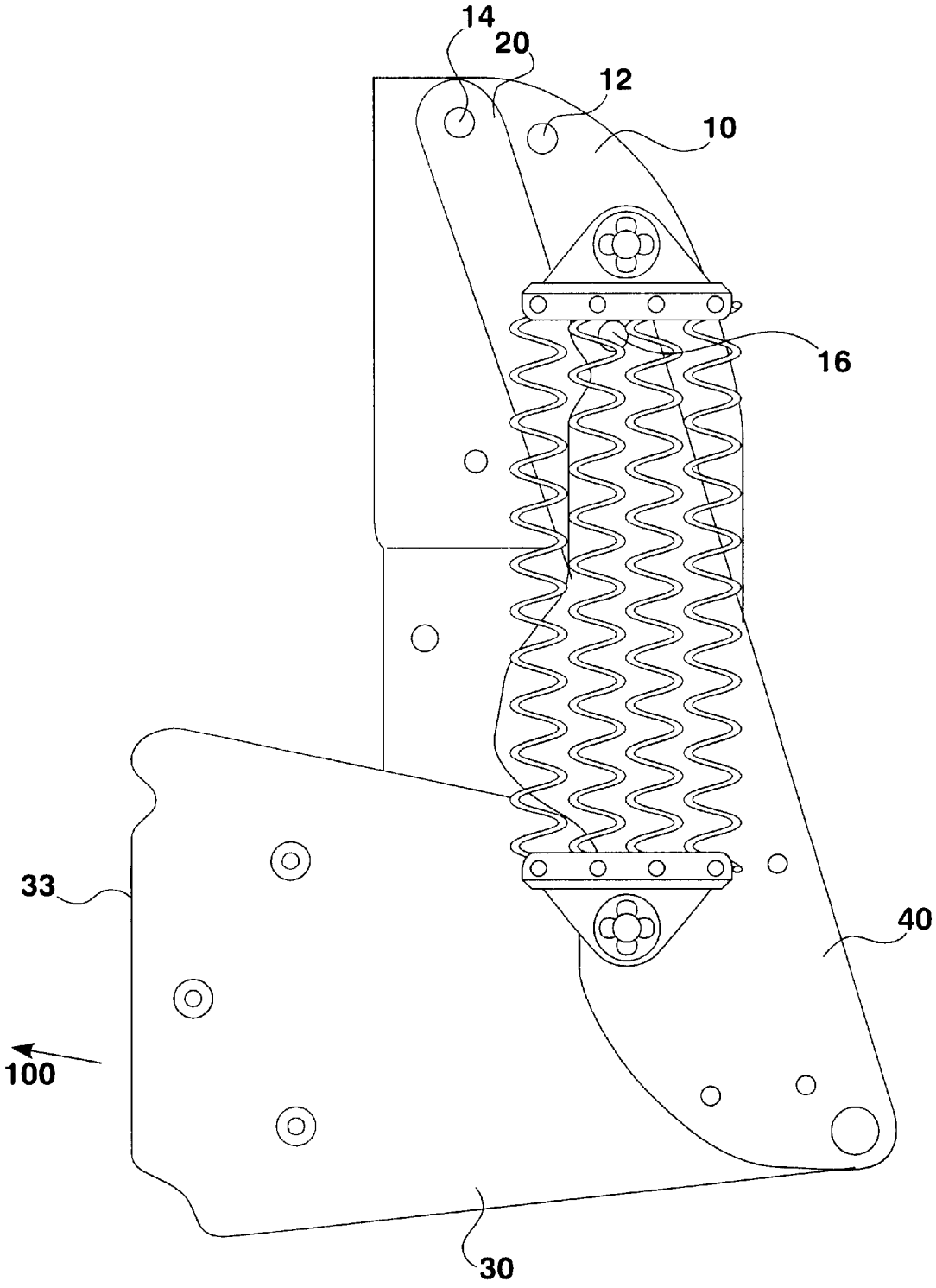

FIG. 2*a* is a side elevational view of the fully assembled hinge in the closed position.

Figure 2B:
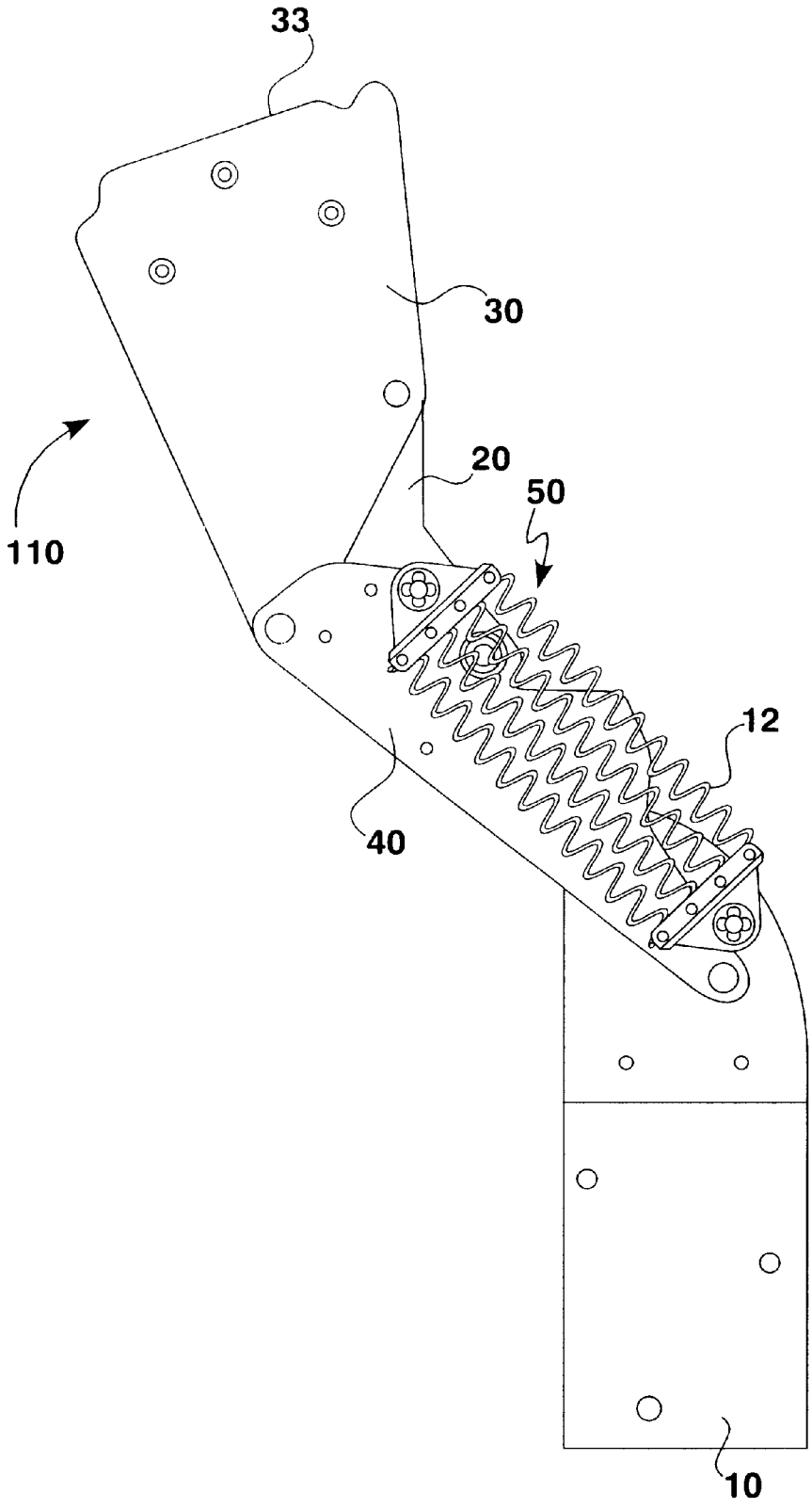

FIG. 2*b* is a side elevational view of the fully assembled hinge in the completely opened position.

FIGS. 3*a*–3*d* illustrate the hinge in various stages between the closed position and the opened position demonstrating the travel of the portion of the hinge connected to the cabinet door.

Figure 4:
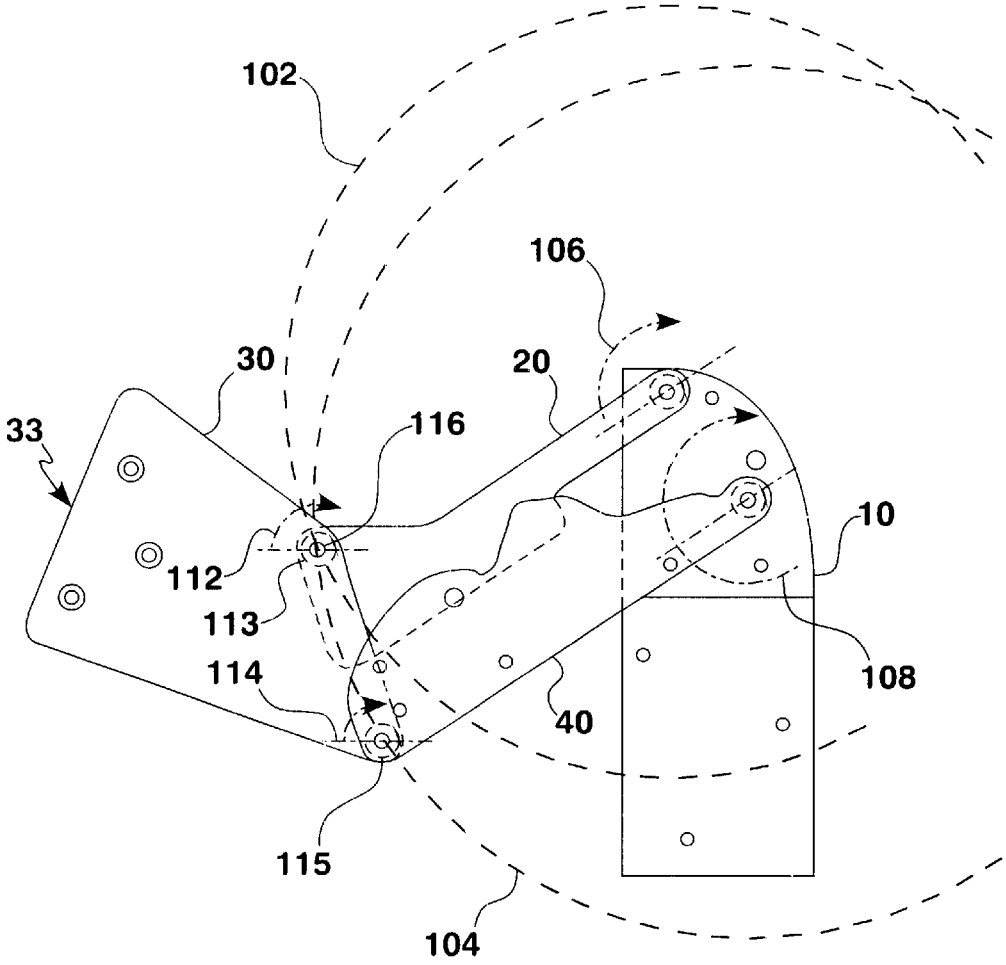

FIG. 4 is a side elevational view of the hinge showing the path of travel of the hinge.

DETAILED DESCRIPTION OF THE INVENTION

The construction of the novel hinge disclosed herein is best shown in the exploded view of FIG. 1. The hinge consists of four structural members 10, 20, 30 and 40 and spring assembly 50 as shown in FIG. 1. Stationary member 10 connects to the interior, side wall of the cabinet via screws or other fasteners attached through holes 18. First pivoting member 20 is connected at one end to stationary member 10 through a mating connection of post 14 and bore 22. Thus, first pivoting member 20 can freely rotate about post 14, as shown by arrow 106 in FIG. 4. Second pivoting member 40 is attached to stationary member 10 via rivet 44 which extends through bore 42, defined in second pivoting member 40, and into a bore defined in standoff 16 located on stationary member 10. Thus, second pivoting member 40 is able to freely rotate about standoff 16, as shown by arrow 108 in FIG. 4. Moving member 30 is connected to the interior portion of the cabinet door via standoffs 32. In addition, moving member 30 has connections to both first and second pivoting members 20 and 40 respectively. Moving member 30 connects to first pivoting member 20 via rivet 24 through hole 26 defined in first pivoting member 20 and hole 34, defined in moving member 30, and pivots about point 113 following arrow 112 in FIG. 4. First pivoting member 20 is connected to side 30*a* of moving member 30, which is the side closest to stationary member 10. Second pivoting member 40 is connected to the opposite side 30*b* of moving member 30 via rivet 56, which extends through hole 46 in second pivoting member 40 and hole 36 in moving member 30, thereby allowing moving member 30 to pivot about point 115 following arrow 114 in FIG. 4.

Preferably members 10, 20, 30 and 40 of the hinge are made of twelve gauge steel. However, in alternative embodiments, the hinge may be constructed of light weight aluminum or synthetic materials. The selection of the material and the thickness thereof is dictated by the desired carrying capacity of the hinge. Additionally, the hinge shown in all of the drawings is a hinge for the left-hand side of the cabinet, as should be obvious to anyone of skill in the art. The hinge for the right-hand side of the cabinet will be the mirror image of the hinge shown in the drawings.

Spring assembly 50 comprises one or more coil-type springs 52 attached on either end to attachment members 54*a* and 54*b*. Note that in the event only one spring is used, attachment members 54*a* and 54*b* would not be necessary. In the preferred embodiment, four springs 52 are used, each having a spring constant of approximately twelve pounds per inch. However, the number of springs and the size thereof may vary depending upon the weight of the door that is being raised by the hinge. One advantage of using a plurality of smaller springs as opposed to a single or lesser number of larger springs is in the lateral size (thickness) of the overall hinge, which is minimized by the use of multiple smaller springs. Spring assembly 50 is connected on one end to second pivoting member 40 at post 60 via attachment member 54*a* and on the opposite end to stationary member 10 at post 62 via attachment member 54*b*. Push nuts 58 hold attachment members 54*a* and 54*b* to posts 60 and 62 respectively.

Post 12 on stationary member 10 acts as a motion stop which limits the upward travel of the door to which the hinge is connected. Second pivoting member 40 will abut against post 12 when the hinge is at its limit of travel in the upward direction. This is shown in FIG. 2*b*.

FIG. 2*a* shows the hinge in its fully closed position. In operation, to raise the cabinet door, a user will first pull the bottom edge of the cabinet door outwardly away from the cabinet frame in the direction of arrow 100 as shown in FIG. 2*a*. This will cause moving member 30 to move approximately horizontally in the direction of arrow 100. At this stage, leading edge 33 of moving member 30 is in an approximately vertical orientation. As moving member 30 moves horizontally, first and second pivoting members 20 and 40 simultaneously pivot about post 14 and standoff 16 respectively. Pivot points 113 on first pivoting member 20 and 115 on second pivoting member 40 follow paths 102 and 104 respectively, as shown in FIG. 4. Note that paths 102 and 104 cross at point 116. Prior to where the paths cross at point 116, path 104 is outside of path 102. However, after point 116 in the travel of the hinge has been reached path 104 moves inside of path 102, thereby causing moving member 30 to rotate toward stationary member 10, resulting in the movement of edge 33 of moving member 30 to a more horizontal position.

Figure 3A:
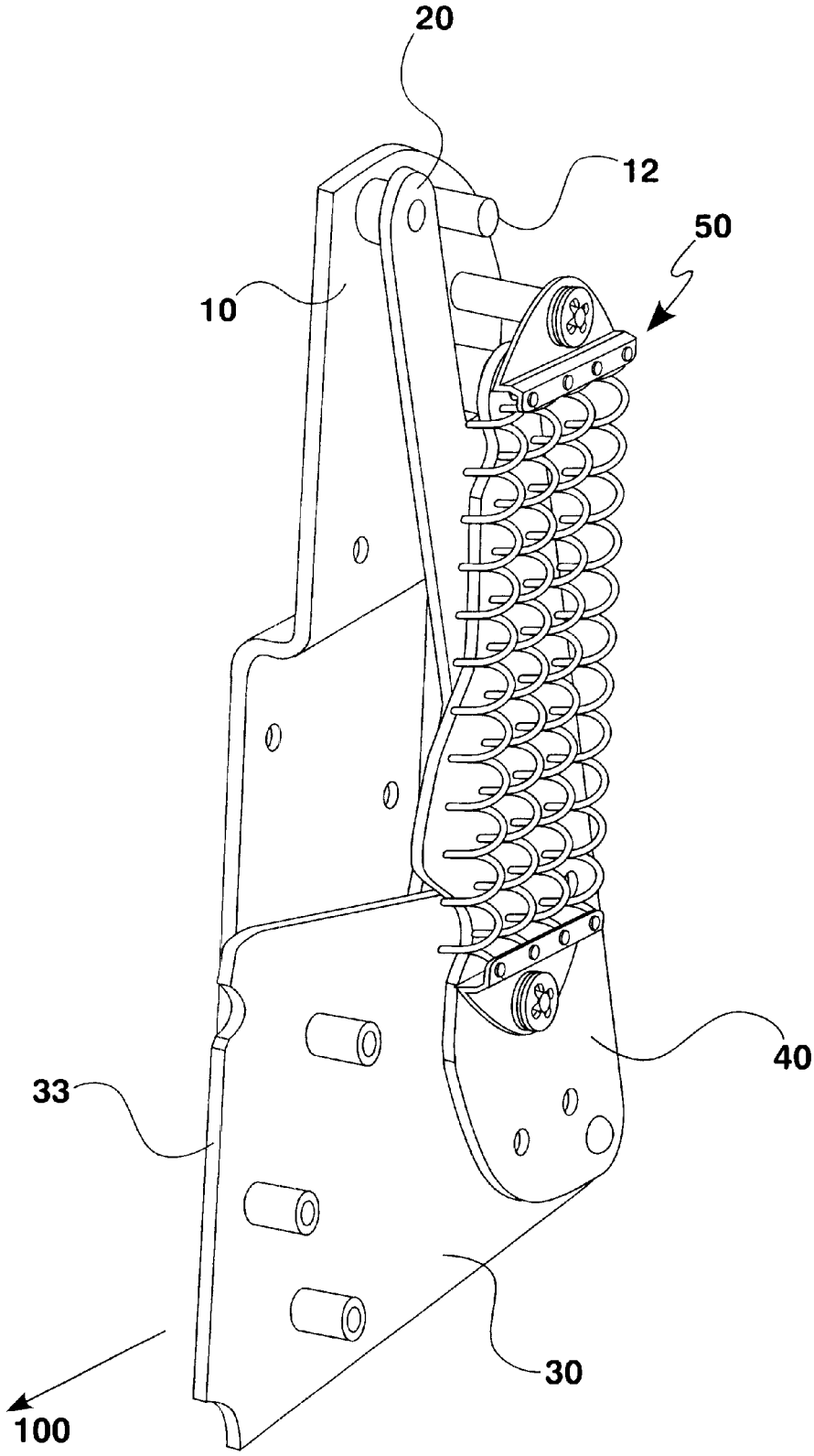
Figure 3B:
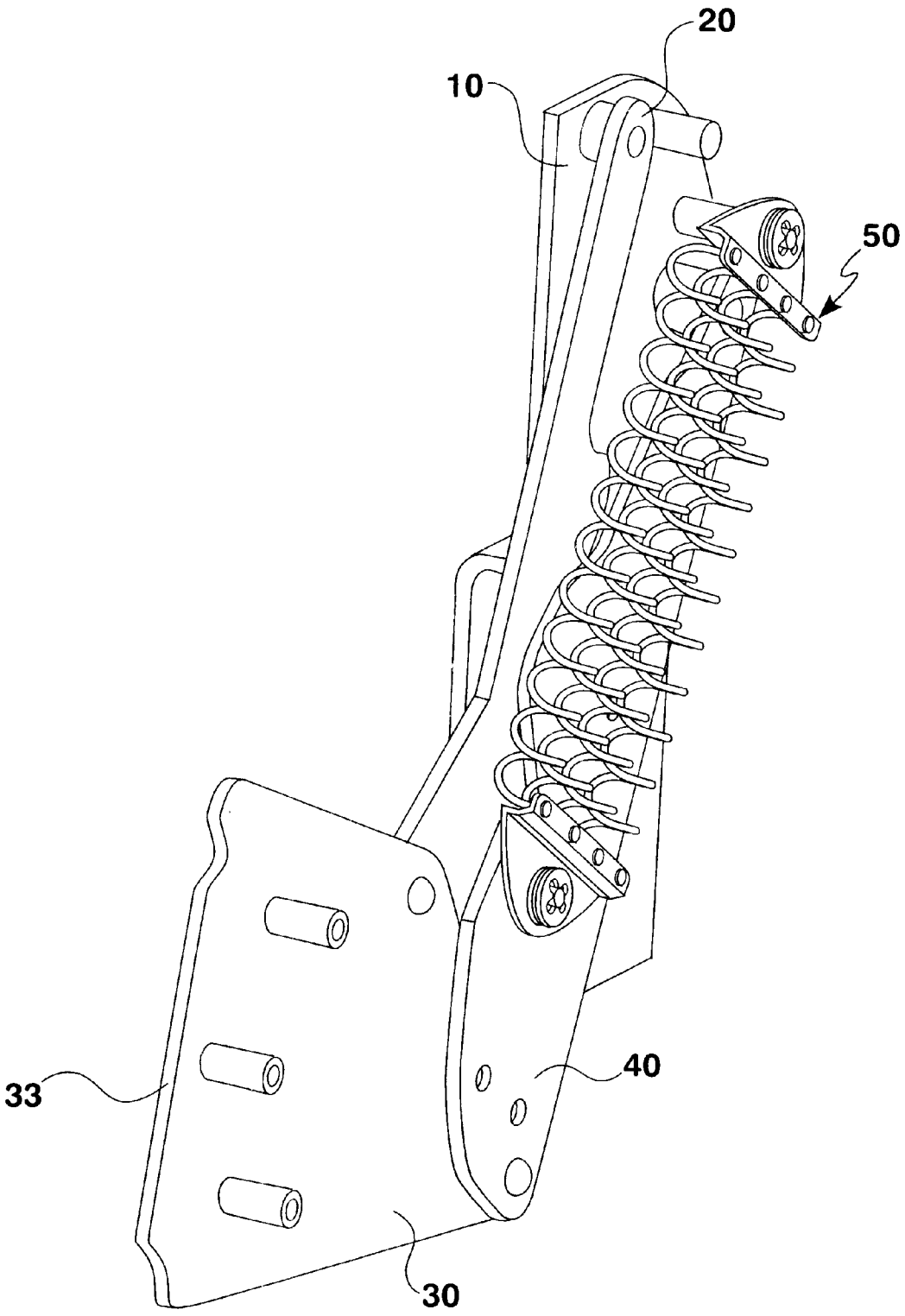
Figure 3C:
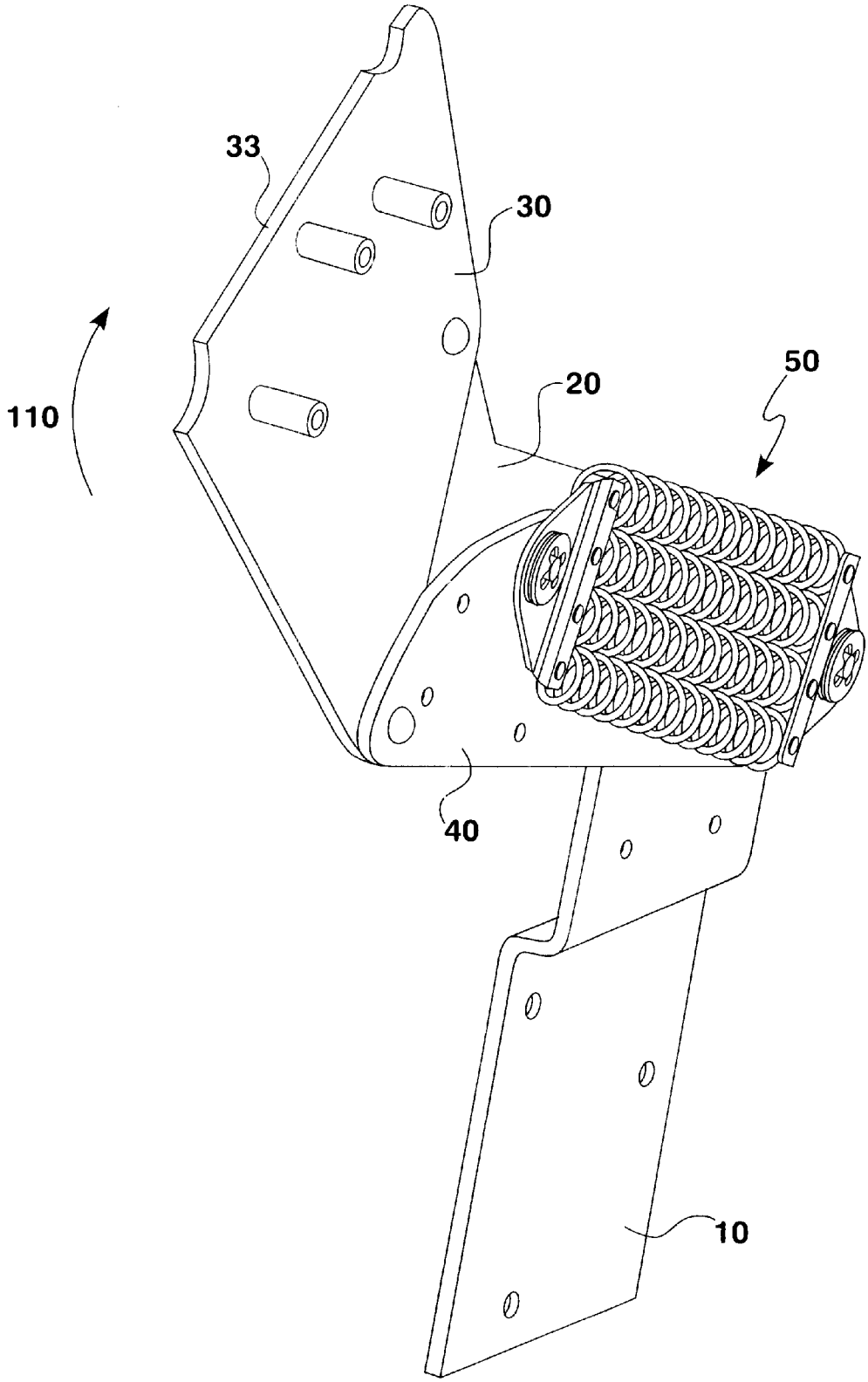
Figure 3D:
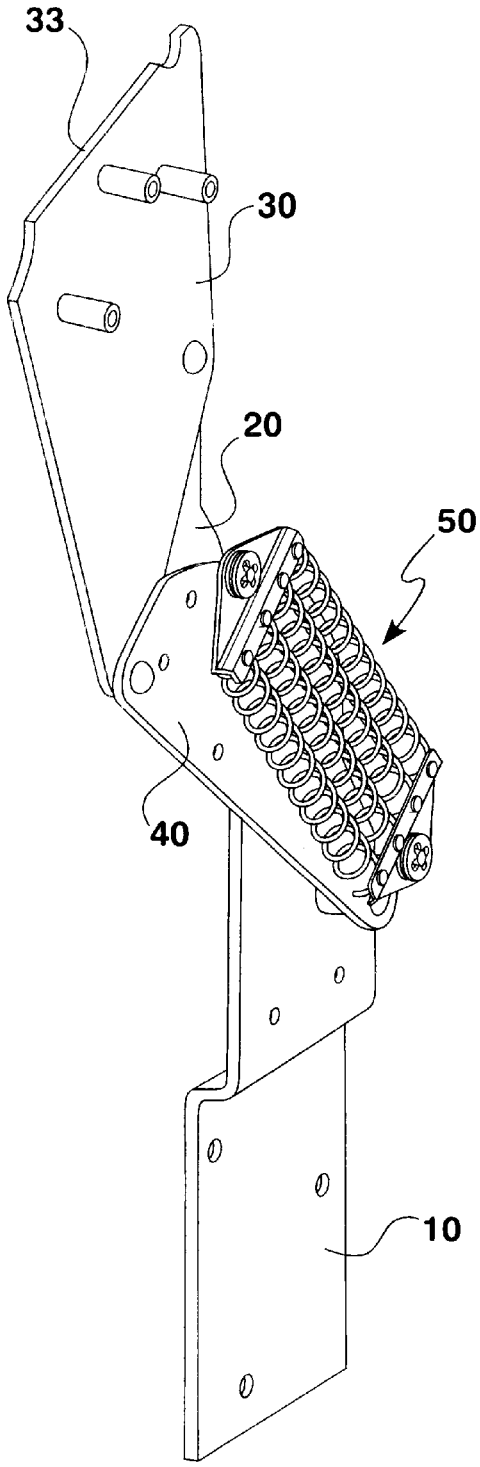

Because of the relative positioning of standoff 16 and post 62, to which spring assembly 50 is connected, during the first portion of the travel of the hinge, springs 52 are held at an almost constant extension. At some point during the travel of the hinge between the fully closed and the fully opened position, approximately as pivot point 115 reaches point 116, springs 52 will begin to retract to their un-extended position. When this happens, the spring assist of the hinge engages and the hinge is pulled to the fully opened position by the retraction of springs 52. Thus, the user need only pull the door in the direction of arrow 100 a portion of the way until the spring assist engages. Also, at some point, the motion of the cabinet door will be more vertical, approximately in the direction of arrow 110, than horizontal, and moving member will rotate, causing the hinge to end up in a position as shown in FIG. 3*d*. FIGS. 3*a*–3*d* show the motion of the hinge in sequence from the fully closed position in FIG. 3*a* to the fully open position of FIG. 3*d*. When closing the door, springs 52 are extended to their greatest point of extension, placing tension of pivoting members 20 and 40 to dampen the motions thereof. This prevents slamming of the door upon closure.

The preferred embodiment of the hinge and the preferred shapes of the structural members 10, 20, 30 and 40 are shown in FIG. 1. However, the actual shapes of these members may vary from what is shown without departing from the spirit of the invention. It is only important that the relationship of the pivot points of the structural members on either ends thereof be retained, as well as their relationship to the connection points of the spring assembly 50. Additionally, standoffs 32, which connect the hinge to the cabinet door are not part of the invention. Any suitable means of connecting moving member 30 to the cabinet door may be utilized.

I claim:

1. A hinge for a cabinet having a vertical door comprising:

a stationary member for attachment to said cabinet;

a moving member for attachment to said door;

a first pivoting member pivotally attached to said stationary member at a single point and pivotally attached to said moving member at a single point;

a second pivoting member pivotally attached to said stationary member at a single point and pivotally attached to said moving member at a single point; and a spring pivotally attached to said stationary member and to said second pivoting member.

2. The hinge of claim 1 wherein said moving member exhibits a non-centered pivoting motion.

3. The hinge of claim 1 wherein said spring is a spring assembly comprising:

two or more springs arranged in a parallel relationship;

a first attachment member connected to one side of said two or more springs; and a second attachment member connected to the opposite end of said two or more springs.

4. The hinge of claim 3 further comprising:

a first post defined on said stationary member; and a second post defined on said second pivoting member;

wherein said first and said second attachment members define holes therein for pivotal connection to said first and said second posts.

5. The hinge of claim 4 wherein said spring assembly contains four springs.

6. The hinge of claim 5 wherein each of said springs has a spring constant of approximately twelve pounds per inch.

7. The hinge of claim 1 further comprising a stop limit defined on said stationary member, said stop limit engaging said second pivoting member when said hinge is in a fully opened position.

8. The hinge of claim 1 wherein said stationary member, said first and second pivoting members and said moving member are constructed from 12 gauge steel.

9. The hinge of claim 1 wherein said spring operates to assist in the opening of said door and further operates to hold said door in an open position.

10. The hinge of claim 1 wherein said spring operates to dampen the motion of said hinge.

11. A hinge for a cabinet having a vertical door comprising:

a stationary member for attachment to said cabinet;

a moving member for attachment to said door;

a first pivoting member pivotally attached to said stationary member and pivotally attached to said moving member at a first pivot point, said first pivot point circumscribing a first arc as said door is opened or closed;

a second pivoting member pivotally attached to said stationary member and pivotally attached to said moving member at a second pivot point, said second pivot point circumscribing a second arc as said door is opened or closed; and a spring pivotally attached to said stationary member and to said second pivoting member, wherein said first arc and said second arc intersect.

12. The hinge of claim 11 wherein said spring is a spring assembly comprising:

two or more springs arranged in a parallel relationship;

a first attachment member connected to one side of said two or more springs; and a second attachment member connected to the opposite end of said two or more springs.

13. The hinge of claim 11 further comprising a stop limit defined on said stationary member, said stop limit engaging said second pivoting member when said hinge is in a fully opened position.

14. The hinge of claim 11 wherein said spring operates to assist in the opening of said door and further operates to hold said door in an open position.

15. The hinge of claim 11 wherein said spring operates to dampen the motion of said hinge.

* * * * *